United States Patent [19]

Tajima

[11] 4,041,898

[45] Aug. 16, 1977

[54] METAL SPRAYING APPARATUS

[75] Inventor: Akiyoshi Tajima, Takatsuki, Japan

[73] Assignee: Osaka Welding Industrial Co., Ltd., Ibaraki, Japan

[21] Appl. No.: 709,223

[22] Filed: July 27, 1976

[30] Foreign Application Priority Data

Oct. 29, 1975 Japan ..... 50130729

[51] Int. Cl.[2] ..... B05B 15/04

[52] U.S. Cl. ..... 118/301; 118/305; 239/150

[58] Field of Search ..... 118/301, 305, 323, 406; 239/103, 104, 150, 288, 288.3, 288.5

[56] References Cited

U.S. PATENT DOCUMENTS

| | | | |
|---|---|---|---|
| 2,733,172 | 1/1956 | Brennan | 118/301 X |
| 2,740,375 | 4/1956 | Diehl et al. | 118/301 |
| 3,036,550 | 5/1962 | Remington et al. | 118/301 |
| 3,903,842 | 9/1975 | Bowling | 118/301 |

*Primary Examiner*—Louis K. Rimrodt

*Attorney, Agent, or Firm*—Armstrong, Nikaido & Marmelstein

[57] ABSTRACT

An apparatus comprises a conveyor for conveying works held to its support members with the desired surfaces of the works to be treated closely arranged in a low; preheating gas burners arranged below the path of travel of the desired work surfaces to heat the works from below during travel; a first metal spray nozzle, a second metal spray nozzle and a fusing nozzle which are arranged in such order above the path of travel of the work surfaces; and heat-resistant metal disks provided beside the metal spray nozzles respectively, each of the disk being rotatably supported and so inclined that the lower portion thereof exposes the desired work surface only and shields the other work portion from the metal spray nozzle. The disks are rotated during spraying operation by drive means. Melted metal such as self-fluxing alloy, etc. is sprayed onto the desired work surfaces only, while being prevented from deposition on the other work portions.

4 Claims, 3 Drawing Figures

METAL SPRAYING APPARATUS

BACKGROUND OF THE INVENTION

Conventionally, melted metal powder is sprayed onto the friction surfaces of cam followers and rocker arms for motor vehicle engines to form hard metal layers. The molten metal forced out from the spray nozzle spreads out in a conical form and a large amount of the metal is wasted, since the surface of the work to be treated is small. However, because the stream of the molten metal jetted out in a conical shape from the nozzle differs in metal density between the central portion and the outer peripheral portion of the stream, it is impossible to form a hard metal layer of uniform thickness on the friction surface of the work, if the stream from the nozzle is constricted. Accordingly it has been practiced to direct the central portion only of the spread-out stream toward the friction surface of the work, without allowing the outer peripheral portion of the stream to impinge on the friction surface. Japanese Patent Specification for Objection SHO. No. 45-32607 and Japanese Patent Specification for Public Inspection SHO. No. 50-106828 disclose an apparatus in which only the work surface to be treated is adapted to be exposed with the other portion covered with a mask plate. The apparatus includes conveyor means for carrying works as arranged thereon in one or two rows with their desired work surfaces positioned close to each other, a gas burner disposed below the path of travel of the work surfaces, and a metal spray nozzle and a fusing nozzle provided above the path of travel, such that a large number of works are continuously treated while being passed below the spray nozzle. With the apparatus disclosed, the mask is placed directly on the work surface and is exposed to the metal stream from the spray nozzle, with the result that sprayed metal is deposited on the mask surface in the form of a thick layer. During the spraying operation, therefore, the mask must be periodically replaced to remove the deposited metal layer from the mask surface.

SUMMARY OF THE INVENTION

The present invention provides an apparatus comprising a metal spraying nozzle and a masking disk facing the nozzle and rotatable during the spraying operation, the lower portion of the disk being positioned close to the desired surface of the work to be treated. The masking disk prevents deposition of the metal on the undesired portions and reflects part of the sprayed metal, permitting the metal stream to impinge concentrically on the desired work surface to thereby reduce the waste of expensive sprayed metal such as self-fluxing alloy, etc. The disk is further prevented from overheating to permit a continuous operation of the metal spraying apparatus.

DETAILED DESCRIPTION OF THE INVENTION

Figure 1:
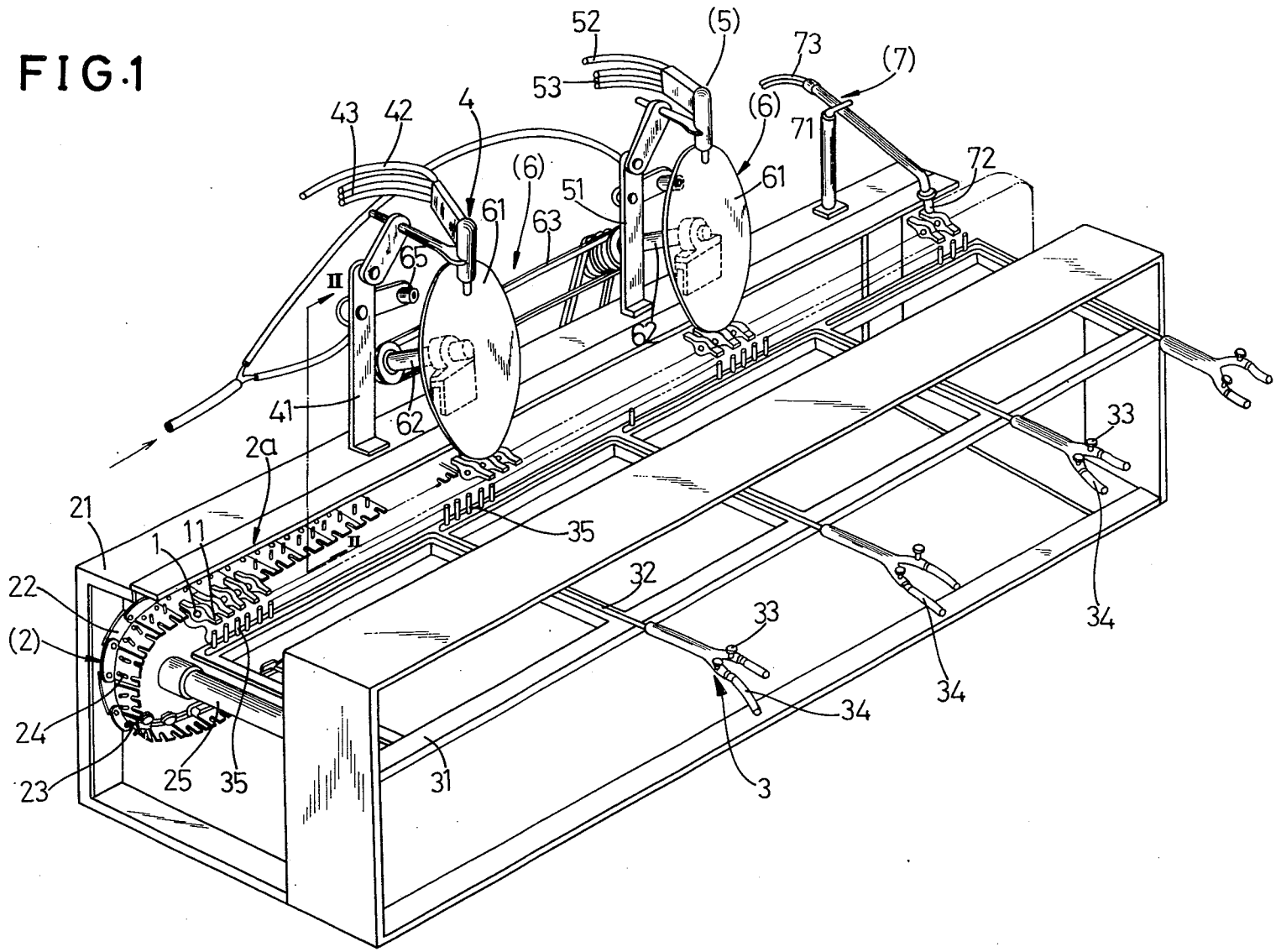
FIG. 1 is a perspective view of a metal spraying apparatus of this invention.
Figure 2:
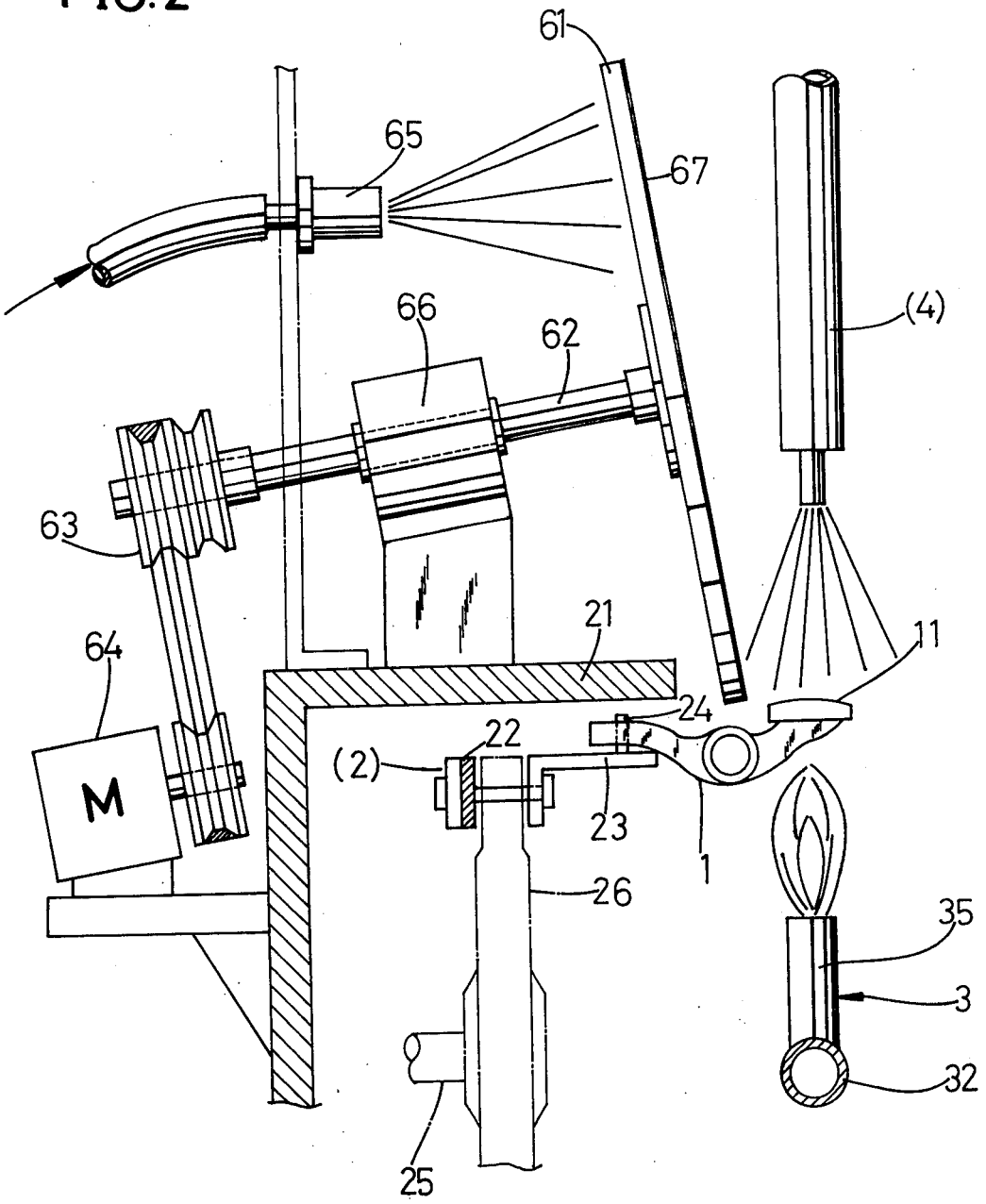
FIG. 2 is an enlarged view in section taken along the line 11—11 in FIG. 1 to show the arrangement of a work, a burner, a spray nozzle and masking means.

The metal spraying apparatus of this invention includes endless conveyor means 2 on which works 1 such as cam followers or rocker arms as illustrated in FIG. 2 are arranged side by side in the direction of travel and are continuously sprayed.

The conveyor means 2 includes a drive shaft and a driven shaft 25 disposed in parallel to each other and projecting horizontally from the opposite ends of a main frame 21. An endless conveyor chain 22 is reeved around wheels 26 on the two shafts. The drive shaft coupled to unillustrated drive means having speed reduction means drives the chain 22 in a downstream direction at a predetermined speed.

Each link plate of the chain 22 is provided with a support member 23 projecting horizontally from the plate and having a predetermined width and a predetermined length in conformity with the work 1. A holder 24 for holding the base end of the work 1 is provided on the front end upper surface of the support member 23. The holder 24 may be variously modified in conformity with the shape of the base end of the work 1. When the work 1 has a hole in its base end, the holder is in the form of a pin. The holder 24 may otherwise comprise two pins adapted to clamp the base end of the work 1. The works 1 are arranged in a row in the direction of advance with their desired work surface up.

Disposed below the conveyor means 2 are a number of preheating burners 35 equidistantly arranged in parallel to each other and projecting upward toward the desired surfaces 11 of works 1 to be treated. The burners 35 are connected to gas supply ducts 32 on a support frame 31 disposed in parallel to the main frame 21. The gas supply ducts 32 are connected via cocks 33 and rubber tubes 34 to a gas main conduit (not shown). The work surfaces 11 are preheated by the flames of the burners 35.

Above the path of travel of the works 1, there are provided a first metal spray nozzle 4 and a second metal spray nozzle 5 spaced by a specified distance in the direction of travel and directed toward the surfaces 11 of the works 1 to be treated.

The spray nozzles 4 and 5 are tiltably mounted on support posts 41 and 51 on the frame 21 and each directed toward the work surface 11. Tubes 42, 43 and 52, 53 for feeding acetylene gas and metal powder to be sprayed are connected to the nozzles 4 and 5 respectively. The metal powder is heated by the gas to about 500° to 600° C and sprayed in a molten state. The metal powder is sprayed from the first nozzle 4 at such a rate that, for example, an approximately 0.1-mm thick metal layer can be formed on the desired work surface 11 while the work 1 is passing below the nozzle. The second spray nozzle 5 sprays the metal powder at such a rate that a metal layer having a finished thickness, for example, of about 0.3 mm can be formed on the work surface passing therebelow.

Facing each of the spray nozzles 4 and 5 is masking means 6 according to this invention by which the desired work surface is left exposed with the other portion of the work shielded from the spray. The masking means 6 includes a disk 61 inclined about 20° so that its upper portion is positioned away from the spray nozzle 4. The disk 61 has a rotary shaft 62 supported by bearing means 66 on the frame 21. The lower peripheral edge of the disk 61 is positioned close to the path of travel of the end portion of the work surface 11. The work surface 11 to be treated opposes the spray nozzle 4, while the other portion of the work is shielded by the disk 61. The disk 61 is rotatable at a constant speed (about 50 rpm) by drive means 64 coupled through transmission means 63 to the end of the rotary shaft 62. When required, a hard layer 67 of ceramic coating is formed on the front surface of the disk 61. When it is necessary to cool the disk 61, an air nozzle 65 is provided behind the rear surface of the disk 61 in opposed relation thereto to cool the disk 61 with an air jet and to thereby mitigate the thermal influence thereon due to the high temperature of the sprayed metal powder.

Downstream from the second spray nozzle 5, the path of travel of the works is provided with fusing means 7 for heating the metal layers formed on the work surfaces 11.

The fusing means 7 includes a gas burner 72 mounted on a support post 71 on the frame 21 and directed toward the work surface 11. The burner 72 is connected to a gas supply duct 73.

Figure 3:
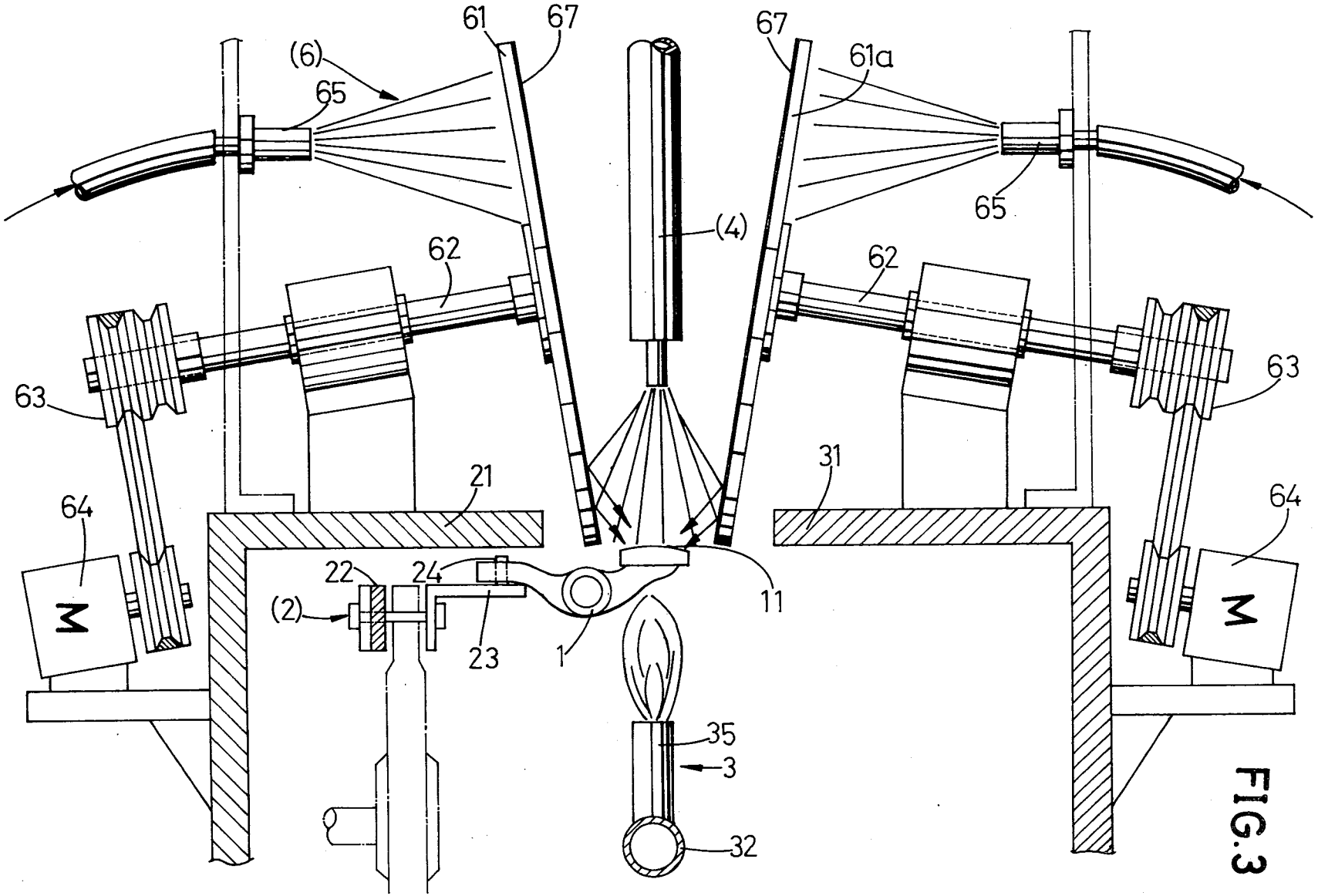
FIG. 3 is an enlarged view in section showing another embodiment of this invention.

As seen in FIG. 3, the masking means 6 can be arranged symmetrically on the opposite sides of the path of travel of the works with the spray nozzle 4 interposed therebetween. With the symmetrical arrangement of all the disks 61, drive means 64 and air nozzles 65, the conical metal stream jetted out from the nozzle 4 impinges on the opposed disks 61 and **61*a* and is thereby reflected, concentrating on the work surface 11,** with the result that the melted metal stream can be used very effectively.

OPERATION

The burners 35 of the preheating means 3 are ignited, and the conveyor means 2 is brought into operation. Upstream from the first metal spray nozzle 4, the base ends of the works 1 are held one after another to the support members 23 of the conveyor means 2, with the desired work surfaces 11 arranged in a row and facing upward. During travel, the works 1 are heated while passing over the flames of the burners 35, and the work surfaces 11 are preheated to about 100° C before they are brought to the position below the spray nozzle 4.

When the work 1 passes below the first spray nozzle 4, the work surface 11 to be treated is brought into face-to-face relation to the nozzle 4, with the other portion of the work 1 shielded by the rotating disk 61. On the other hand, the metal powder such as powder of self-fluxing alloy, etc. which has been heated to about 500° to 600° C in a molten state by the gas is sprayed onto the surface 11. Thus while the surface 11 passes below the nozzle, a 0.1-mm thick metal layer is formed thereon. The portion of the metal powder sprayed outwardly of the surface 11 is reflected from the disk 61 of the masking means 6 and is thereby led onto the surface 11, whereby the waste of the metal powder is reduced. The air applied to the rear surface of the disk 61 from the air nozzle 65 cools the disk 61, rendering the disk free of the thermal influence to be otherwise produced by the high temperature of the melted metal powder and permitting the disk to retain an effective masking action.

When the work 1 passes below the second metal spray nozzle 5 downstream from the nozzle 4 after having passed under the nozzle 4, melted metal powder is again sprayed onto the surface of the metal layer already formed. While the work 1 passes below the nozzle 5, a metal layer having a finished thickness of about 0.3 mm is formed, and the work 1 is then led to the position under the fusing means 7 which is located downstream from the nozzle 5. The sprayed metal layer formed on the work surface is heated by the flame of the gas burner 72 of the fusing means 7, rendered smooth-surfaced and gradually cooled. The treated work is released from the support member 23 at the downstream turning portion of the conveyor means 2. Thus the finished works are discharged to an unillustrated chute one after another.

Because the disk 61 has on its surface the hard layer 67 of ceramic coating, hardly any sprayed metal is deposited on the disk surface. The slight metal deposit which may result from one day's continuous operation is readily removable by knife or the like after the operation. The deposit can be comminuted for reuse.

After the metal layer on the work surface 11 has been cooled, the metal layer surface is finished with an abrasive by a simple procedure to complete an abrasion resistant hard metal layer 12.

The invention described above has the following advantages. The rotation of the masking disk 61 provides an air-cooling effect on the disk, eliminating the thermal influence of the sprayed metal powder on the disk to ensure a continuous operation for a prolonged period of time. Furthermore the conically spread metal stream forced out from the nozzle can be sprayed concentrically onto the desired work surface, whereby a great reduction is achievable in the consumption of the spray metal.

This invention is not limited to the embodiments described above and illustrated in the drawings. It is to be understood that other changes and modifications may be made by those skilled in the art without departing from the scope of this invention.

I claim:

1. A metal spraying apparatus comprising conveyor means for supporting and conveying works to be sprayed; preheating means disposed along the path of travel of the works for preheating the works from below; a plurality of metal spray nozzles arranged above and along the path of travel of the works for spraying melted metal powder onto the desired surface of each of the works to be treated to form a metal layer thereon; masking means for exposing the desired surface of the works and shielding the other portions of the works from the spray nozzle, the masking means including a masking disk disposed at the spraying position and so inclined that the lower portion thereof is positioned close to the path of travel of the works to expose the desired work surface and shield the other portion of the works, the masking disk being rotatably supported and coupled to drive means; an air nozzle being arranged remote from the masking portion of the masking disk and being arranged behind the upper portion of the rear surface of the masking disk in opposed relation thereto to spray air onto the rear surface of the upper portion of the disk to thereby cool the disk; and a fusing nozzle for heating the sprayed metal surface to a high temperature provided at a downstream portion of the conveyor means, the fusing nozzle being positioned above the path of the works.

2. A metal spraying apparatus as defined in claim 1 wherein the masking means comprises two disks disposed on the opposite sides of the path of travel of the works with the metal spray nozzle interposed therebetween, and the desired work surfaces pass through a space between the lower portions of the two disks.

3. A metal spraying apparatus as defined in claim 1 wherein the masking disk is formed on its front surface with a hard layer of ceramic coating.

4. A metal spraying apparatus as defined in claim 1 wherein the conveyor means comprises a revolvable endless chain, each link plate of the chain having a holder for releasably supporting the base end of the work.

* * * * *